US005230249A

United States Patent [19]

Sasaki et al.

[11] Patent Number: 5,230,249

[45] Date of Patent: Jul. 27, 1993

[54] SHOE OR BOOT PROVIDED WITH TANK CHAMBERS

[75] Inventors: Ken Sasaki, Higashiyamato; Yoshio Ono, Ome; Etsuro Nakajima, Akishima; Masayoshi Okuyama, Higashiyamato, all of Japan

[73] Assignee: Casio Computer Co., Ltd., Tokyo, Japan

[21] Appl. No.: 741,753

[22] Filed: Aug. 7, 1991

[30] Foreign Application Priority Data

| | | | |
|---|---|---|---|
| Aug. 20, 1990 | [JP] | Japan | 2-217097 |
| Aug. 23, 1990 | [JP] | Japan | 2-219975 |
| Oct. 29, 1990 | [JP] | Japan | 2-291525 |

[51] Int. Cl.[5] ..... G01L 7/00

[52] U.S. Cl. ..... 73/714; 36/132; 73/172; 73/756

[58] Field of Search ..... 73/172, 862.58, 178 R, 73/379, 714, 756, 715, 706; 128/DIG. 12, 779; 606/192; 604/141, 151; 36/132, 114, 29

[56] References Cited

U.S. PATENT DOCUMENTS

| | | | |
|---|---|---|---|
| 2,558,805 | 7/1951 | Yaglou | 73/172 |
| 3,355,942 | 12/1967 | Freeman | 73/178 R |
| 4,571,680 | 2/1986 | Wu | 364/410 |
| 4,578,769 | 3/1986 | Frederick | 364/565 |
| 4,649,552 | 3/1987 | Yukawa | 377/24 |
| 4,651,446 | 3/1987 | Yukawa et al. | 36/132 |
| 5,107,854 | 4/1992 | Knotts et al. | 73/172 |

FOREIGN PATENT DOCUMENTS

| | | |
|---|---|---|
| 0119009 | 9/1984 | European Pat. Off. . |
| 0152057 | 8/1985 | European Pat. Off. . |
| 0299669 | 1/1989 | European Pat. Off. . |
| 3-18302 | 1/1991 | Japan . |
| WO87/03789 | 7/1987 | World Int. Prop. O. . |
| WO90/09114 | 8/1990 | World Int. Prop. O. . |

*Primary Examiner*—Donald O. Woodiel

*Attorney, Agent, or Firm*—Frishauf, Holtz, Goodman & Woodward

[57] ABSTRACT

A footwear of the present invention is provided with tank chambers which are disposed to be in contact with an instep, sole and ankle of the user for applying pressure thereto to protect his foot from shocks. The tank chambers are filled with air and air pressure within the tank chambers can be adjusted. The footwear is further provided with a pressure sensor for measuring air pressure within the tank chambers to generate a pressure signal, and a pressure data displaying device for indicating pressure data on the basis of the pressure signal generated by the pressure sensor. Therefore, the user can make sure on the pressure data display device a pressure level at which the most suitable pressure for his foot is obtained. The user is also allowed to extremely easily adjust the air pressure at the above pressure level, watching an indication on the pressure data display device.

45 Claims, 15 Drawing Sheets

SHOE OR BOOT PROVIDED WITH TANK CHAMBERS

BACKGROUND OF THE INVENTION

1. Field of the Invention

The present invention relates to a shoe or boot which is provided in its inside portion with tank chambers which are filled with air, supporting and protecting a human foot from shocks imposed thereto.

2. Prior Art

Shoes have been proposed which are provided with a sensor for counting the number of steps taken by a user during walking or jogging to accumulate and indicate the number of steps taken within a certain time interval. Such shoes are disclosed, for example, in U.S. Pat. Nos. 4,651,446, 4,649,552, 4,578,769 and 4,571,680.

In sports, athlete's weight abruptly imposed to his foot could often be a cause of an injured foot. For lightening such burden imposed on foot, so called pump shoes are in use. The pump shoes are provided with tank chambers filled with air in its sole, instep and part in contact with a user's ankle respectively to prevent shocks from being applied to the user's foot and also to support his feet in a natural manner. By using the pump shoes, athlete can prevent his feet from being injured by shocks.

In the pump shoes, excessively low air pressure within the tank chambers provides neither a comfortable cushion nor a p63 sufficient support for his feet. On the contrary, excessively high air pressure within the tank chambers gives an oppressive feeling to the feet of the user, providing him with an uncomfortable feeling.

If the air pressure within the air chambers is adjustable, it will be convenient for the user to obtain preferable cushion and fitness for his feet.

The user, however, is required to determined the air pressure within the air chambers with his sense. Therefore, the user sometimes fills the air chambers with air excessively and has to release air from the air chambers to obtain proper air pressure, and on the contrary he releases air excessively from the air chambers and has to supply air into the air chambers again. In this manner, a time consuming and troublesome work is required to adjust air pressure within the air chambers to a level that is appropriate for the user.

Even though appropriate air pressure has been obtained, air can escape from the air chambers while the user is using the shoes. Therefore, the above air adjusting work has to be done several times to keep the air pressure at a proper level at all times.

SUMMARY OF THE INVENTION

The present invention has been made in the light of the above mentioned situations and has an object of providing shoes or boots provided with tank chambers, within which air pressure can be easily adjusted to a proper level.

Another object of the invention is to provide shoes or boots provided with tank chambers for measuring an amount and hardness of exercise having been conducted by the user and for protecting his feet as well.

To achieve the above objects, the present invention provides a footwear comprises a tank member disposed to be in contact with the foot of a user, for applying pressure thereto; air pumping means for filling said tank member with air; pressure measuring means for measuring air pressure within said tank member to generate a pressure signal, said tank member being filled with air supplied from said air pumping means; and pressure data indicating means for indicating pressure data on the basis of the pressure signal generated by said pressure measuring means.

The above foot wear such as a shoe or boot according to the invention allows the user to easily adjust air pressure within the tank chamber to obtain cushion and fitness comfortable for him. Once he has adjusted air pressure to a certain level such that comfortable cushion and appropriate fitness for him are provided, and memorizes the level of such air pressure, then he can easily obtain proper cushion and fitness thereafter by supplying air into the tank chamber until the indicating means indicates such level of air pressure.

BRIEF DESCRIPTION OF THE DRAWINGS

Embodiments of the invention are described in the following detailed description taken in connection with the accompanying drawings wherein:

FIG. 1 is an external view of a shoe provided with a tank chamber according to the invention;

FIG. 2 is a perspective side-view of the shoe shown in FIG. 1;

FIG. 3 is a cross sectional view of the shoe taken along the line III—III of FIG. 2;

FIG. 4 is a view showing an external appearance of a pressure meter device mounted in the shoe of FIG. 1;

FIG. 5 is a circuit diagram of the pressure meter device;

FIGS. 6 to 12B are views showing the second embodiment of the present invention;

FIG. 6 is a view showing an external appearance of a pressure meter used in the second embodiment;

FIG. 7 is a circuit diagram of the pressure meter device of FIG. 6;

FIG. 8 is a view showing a construction of a register of RAM 23;

FIGS. 9 to 11 are flowcharts of operation of the second embodiment;

FIGS. 12A and 12B are views showing examples of indications in a time indicating mode and in a pressure measuring mode, respectively;

FIG. 13 is a view showing an external appearance of a shoe incorporating the third embodiment of the invention;

FIG. 14 is a view showing an internal construction of the shoe of FIG. 13;

FIG. 15 is a cross sectional view taken along the line XV—XV of FIG. 14;

FIG. 16 is a cross sectional view taken along the line XVI—XVI of FIG. 14;

FIG. 17 is a view showing an external appearance of a pressure meter device used in third embodiment of the invention;

FIG. 18 is a circuit diagram of the pressure meter device of FIG. 17;

FIG. 19 is a view showing a construction of RAM 47 of FIG. 18;

FIGS. 20 and 21 are flowcharts of operation of the third embodiment;

FIGS. 22 and 23 are views showing transpositions in indication, respectively;

DETAILED DESCRIPTION OF THE PREFERRED EMBODIMENTS

Now, embodiments of the present invention will be described with reference to the accompanying drawings.

First Embodiment

Figure 1:
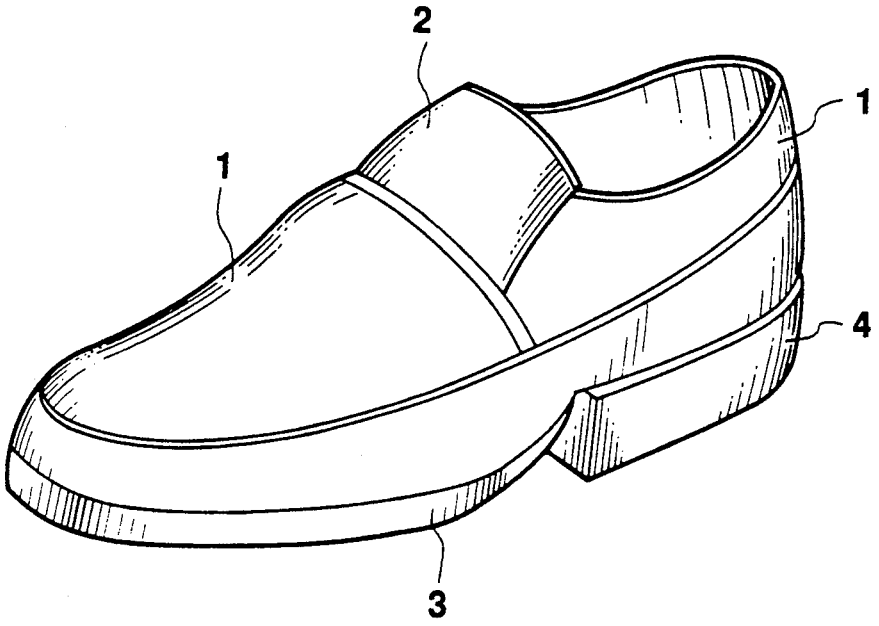
FIGS. 1 to 5 are views showing the first embodiment of the invention.
Figure 2:
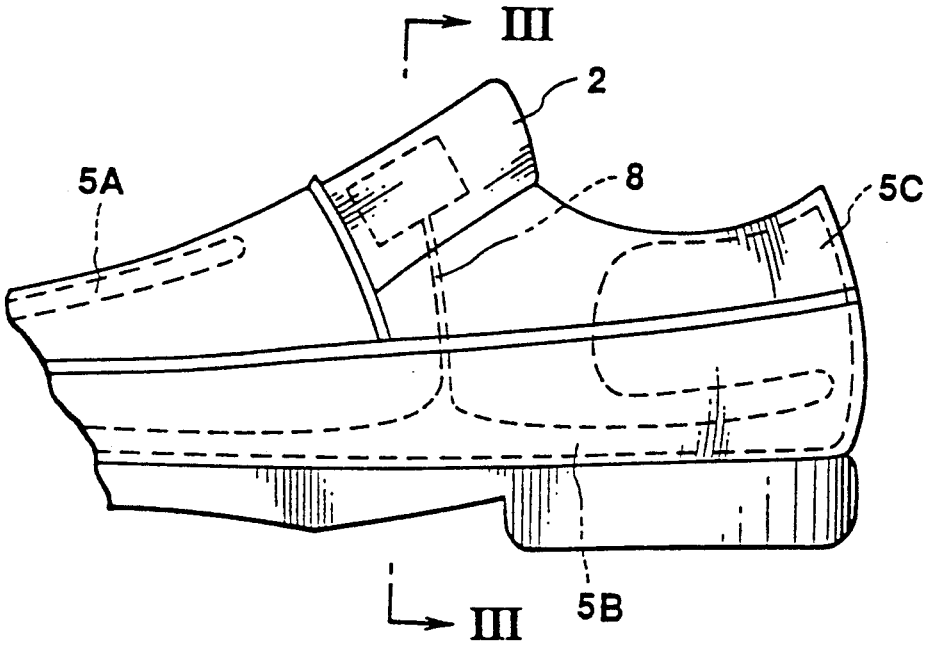
Figure 3:
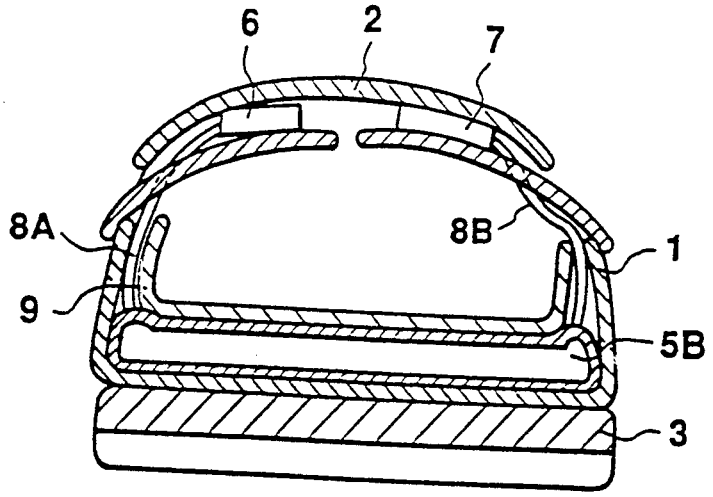

FIG. 1 is a view showing the external appearance of the first embodiment of the invention, i.e., the external appearance of the shoe provided with tank chambers according to the invention, FIG. 2 is a perspective side-view of the shoe shown in FIG. 1 and FIG. 3 is a cross sectional view of the shoe taken along the line III—III of FIG. 2.

As shown in FIG. 1, the shoe provided with air tank chambers comprises of an instep 1, a tongue 2, a sole 3 and a heel 4.

In FIG. 2, the shoe is provided with air tank chambers 5A, 5B and 5C in its instep 1, shoe bottom and in a part surrounding a human ankle respectively, as shown by broken lines. These air tank chambers 5A, 5B and 5C are connected with each other, forming a single air tank 5. The air tank 5 serves to lighten shocks imposed to the foot of a user and serves to support his instep and ankle as well. These air tank chambers 5A, 5B and 5C are made of gum, airtight flexible synthetic resin or an airtight sheet.

As shown in the cross sectional view of FIG. 3, the shoe is provided in its tongue 2 with an air pump 6 for supplying air to the air tank 5 and a pressure meter device 7 for measuring air pressure within the air tank 5. The air pump 6 and pressure meter device 7 are connected with air tank 5 through air pipes 8A and 8B. Air is led from the air pump 6 to the air tank 5 through the air pipe 8A and further air is led from the air tank 5 to the pressure meter device 7 for measurement through the air pipe 8B.

There is provided an under sheet 9 on the shoe bottom, i.e., on the air tank chamber 5B of the air tank 5.

Figure 4:
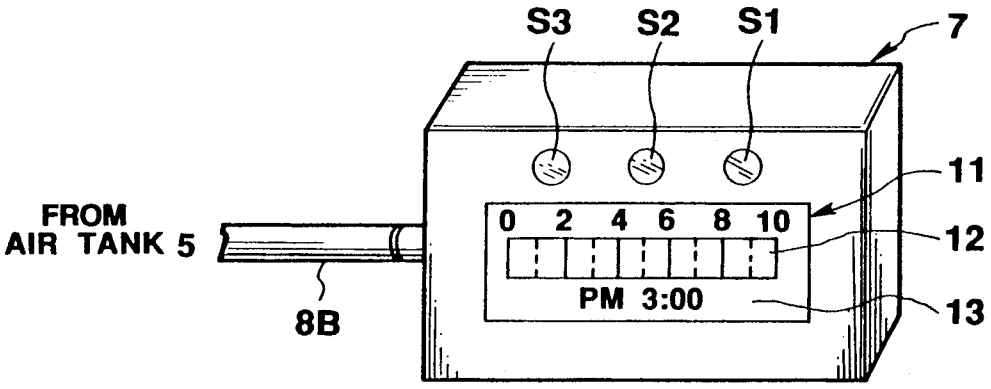
Figure 5:
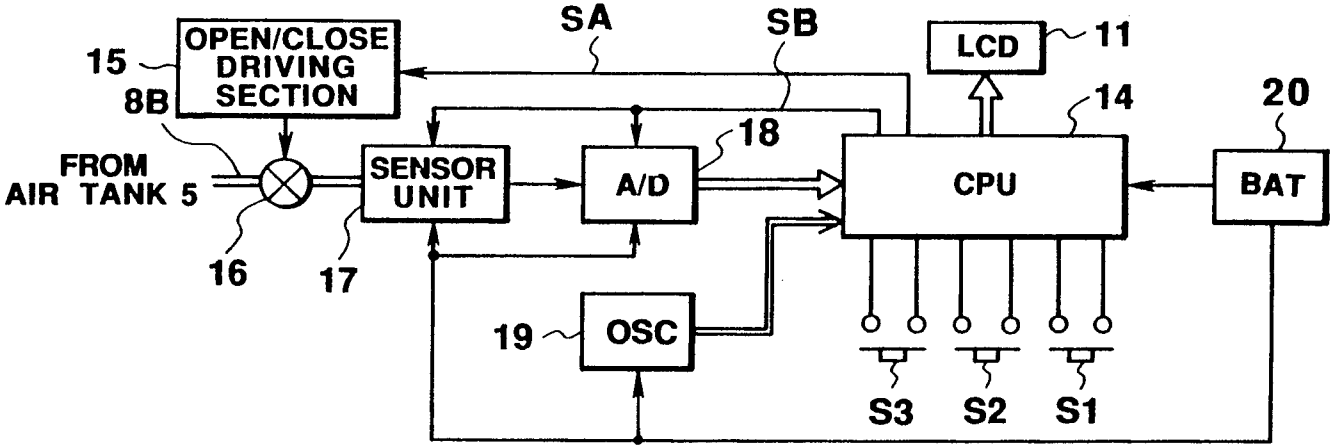

FIG. 4 is a view showing the external appearance of the pressure meter device 7 and its circuit diagram is shown in FIG. 5.

As shown in FIG. 4, there is provided a liquid crystal display unit 11 on the side of the pressure meter device 7. The liquid crystal display unit 11 has a pressure indicating section 12 including ten bar-indicating members. The liquid crystal display unit 11 indicates air pressure in a ten-level fashion with its turned on bar-indicating members. At the lower side to the pressure indicating section 12, there is provided a time indicating section 13, which indicates a present time counted by CPU 14, as will be described below.

The pressure meter device 7 is provided with three switches S1, S2 and S3. The switch S1 is operated for measuring air pressure, and the switches S2 and S3 are operated for correcting time data.

Now, the circuit diagram of the pressure meter device 7 will be described with reference to FIG. 5.

In FIG. 5, CPU 14 stands for a central processing unit, which controls operation for time counting, measurement of air pressure within the air tank 5, and indication of time and air pressure. When the switch S1 is operated to instruct the measurement of air pressure, CPU 14 supplies an open signal SA for opening an air valve 16 to an open/close driving section 15 and at the same time supplies a driving signal SB to a pressure sensor 17 including a semi-conductor pressure sensor and to A/D converter 18.

The air valve 16 is connected with the above air pipe 8B and the pressure sensor 17. When the air valve 16 is open, air in the air tank 5 is led to the pressure sensor unit 17, allowing the pressure sensor unit 17 to measure air pressure within the air tank 5.

CPU 14 is supplied with a clock signal and a timing signal each having a certain period from an oscillation circuit (OSC) 19. CPU 14 performs various processes in synchronism with the clock signal supplied thereto. More specifically, CPU 14 performs such processes as a process for supplying signals SA and SB in response to operation of the switch S1, a process for causing the pressure indicating section 12 to indicate measured air pressure and a process for counting a present time at a certain time interval. CPU 14, the pressure sensor unit 17 and A/D converter 18 are supplied with a driving voltage from a battery 20.

Now, operating steps for pumping air into the air tank 5 will be described.

At first, the user puts his foot into the shoe and pulls up the tongue 2 to operate the switch S1, allowing the measurement of air pressure to start. Then, the user depresses the air pump 6 to fill the air tank 5 with air through the air pipe 8A. Since the air tank chambers 5A, 5B and 5C supporting the foot of the user are connected with each other through pipes, tubes and the like, all of these air tank chambers expand as the air pump 6 works.

Air in the air tank 5 is led to the air valve 16 of the pressure meter device 7 through the air pipe 8B. Since, at this time, the air valve 16 is made open by the open/close driving section 15, air in the air tank 5 is further led to the pressure sensor unit 17 through the air valve 16, allowing the pressure sensor unit 17 to measure air pressure. An analog value of air pressure detected by the pressure sensor unit 17 is converted into a digital value by A/D converter 18, and the value of air pressure is indicated in a ten-level fashion on the pressure indicating section 12.

The user of the shoes gradually pumps air into the air tank 5, watching the indication on the pressure indicating section 12 until desired cushion and fitness are obtained. If he should have pumped air too much into the air tank 5, he can adjust the air pressure within the air tank 5 by opening a release valve (not shown) so as to gradually release air from the air tank 5.

In this manner, once he has obtained his desired cushion and fitness, he memorizes the pressure level indicated on the pressure indicating section 12 for the next adjustment of the air pressure.

Even if the air pressure within the air tank 5 should decrease after several days, he can easily adjust the air pressure again so as to obtain his desired cushion and fitness, by pumping air into the air tank 5 watching the pressure level indicated on the indicating section 12.

Accordingly, once the user obtains and memorizes the pressure level for proper cushion and fitness, he can easily obtain the same cushion and fitness again simply by pumping air into the air tank 5 until the pressure level is indicated on the pressure indicating section 12. As the result, there is no need for him to make a fine adjustment of the air pressure depending on his foot feeling as conventional, and the air pumping work to shoe is very simplified.

During the first air pumping work, the indication on the pressure indicating section 12 allows the user to adjust in a short time the air pressure within the air tank at a proper level since he neither pumps nor releases air from the air tank excessively or deficiently as he does while he pumps air by feeling air pressure imposed on his foot.

Second Embodiment

Figure 6:
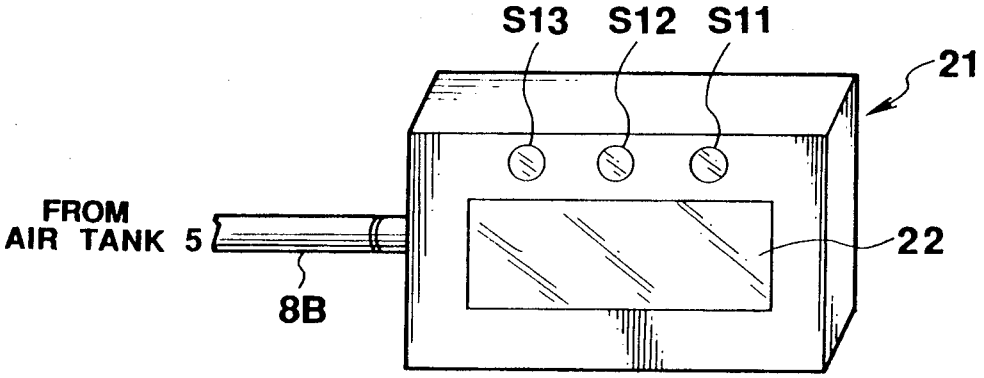
Figure 7:
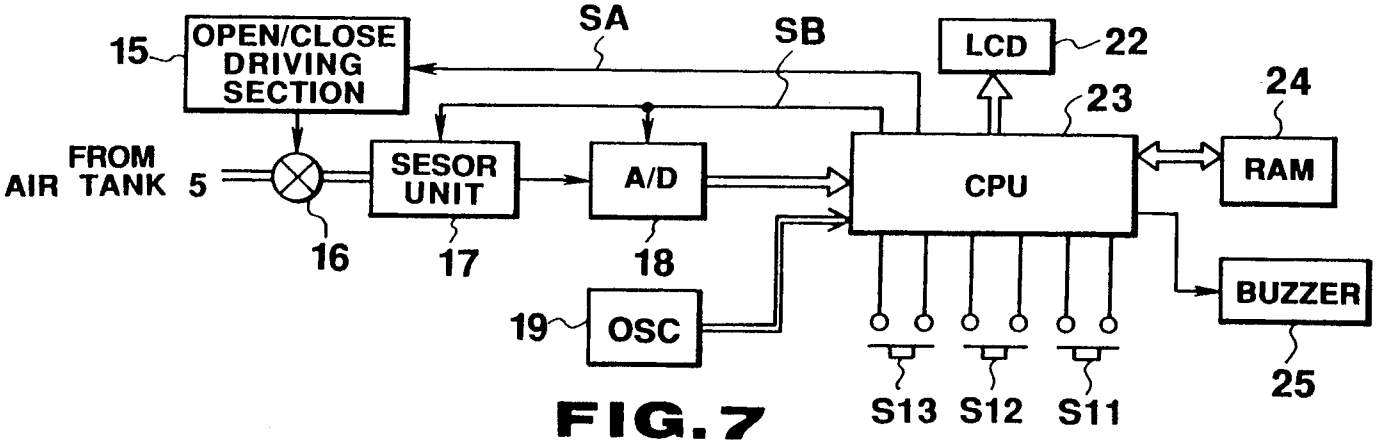

FIGS. 6 and 7 are views showing an external appearance of a pressure meter device 21 used in the second embodiment and its circuit diagram, respectively. In the second embodiment, the pressure meter device 21 of FIG. 6 is used in place of the pressure meter device 7 of the first embodiment. The construction of the second embodiment other than the pressure meter device 21 is similar to that of the first embodiment and its description will be omitted.

The pressure meter device 21 is provided with switches S11, S12 and S13, as shown in FIG. 6. The switch S11 is operated for measurement of air pressure. The switch S12 is operated for storing a value of air pressure after the measurement of air pressure, and for selecting a digit of time indication to be corrected. The switch S13 is operated for setting a figure at the digit selected by the switch S12. The pressure meter device 21 is further provided with a dot-matrix display section 22 for indicating a measured pressure data, a stored pressure data and a present time.

Now, the circuit diagram of the pressure meter device 21 will be described with reference to FIG. 7.

In FIG. 7, CPU 23 is a central processing unit, which stores a micro program, and performs a time counting process, a measurement process of air pressure within the air tank 5, an indication process of indicating a time and air pressure, and a process of storing a present time and measured pressure data in RAM 24 in accordance with the micro program.

Figure 8:
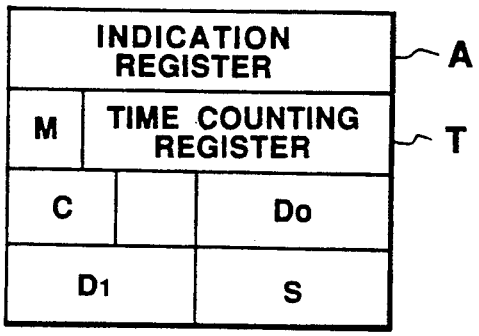

RAM 24 is provided with various registers as shown in FIG. 8. In FIG. 8, a mode register M serves to indicate an operation mode. More specifically, when a time indication mode has been set, a value "0" is set to the mode register M, and when a pressure measurement mode has been set, a value "1" is set to the mode register M.

A time counting register T serves to store a present time counted by CPU 23. A register C is a timer register that counts time intervals for measuring pressure.

Registers D0 and D1 serve to store a presently measured pressure data and previously measured pressure data, respectively. A pressure data memory S serves to store a pressure level determined by the user, that is, the pressure data memory S stores a certain pressure level determined by the user as a target pressure level for a following pressure adjustment.

An indication register A serves to store data to be indicated on the dot matrix display section 22, i.e., it stores data transferred from the time counting register T and the pressure data memory S.

Returning to FIG. 7, the open/close driving section 15 and the air valve 16, A/D converter 18 and the oscillator circuit 19 are similar to those shown in FIG. 5 and their further description will be omitted.

A buzzer 25 gives the audible alarms in two ways during adjustment of air pressure, one when the air pressure is increasing and other when the air pressure is decreasing.

Now, operation of the pressure meter device 21 will be described with reference to the flowcharts of FIGS. 9 to 11 and examples of indication shown in FIGS. 12A and 12B.

Figure 9:
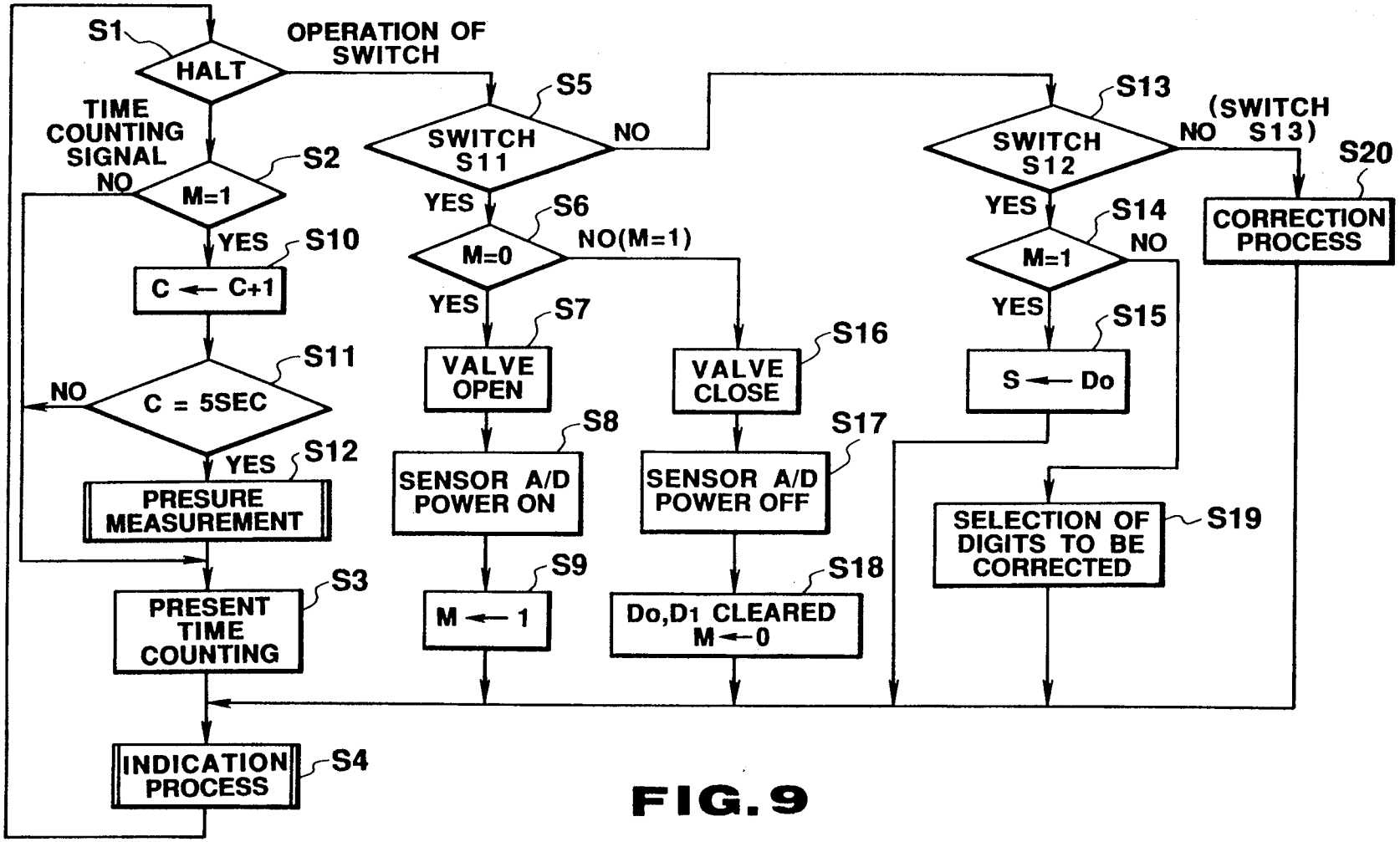

CPU 23 usually remains in a halt state at step S1 of FIG. 9. Every receipt of a time counting signal of one second generated by the oscillator 19, CPU 23 goes to step S2, where it judges if the mode register M has been set to a value "1".

When the mode register M has been set to a value "0", which means that the time indication mode has been set, then the operation goes to step S3, where a present time in the time counting register T is updated. The present time processed in the indication process is indicated at step S4.

The above indication process at step S4 will be described with reference to the detailed flowchart of FIG. 11.

Figure 11:
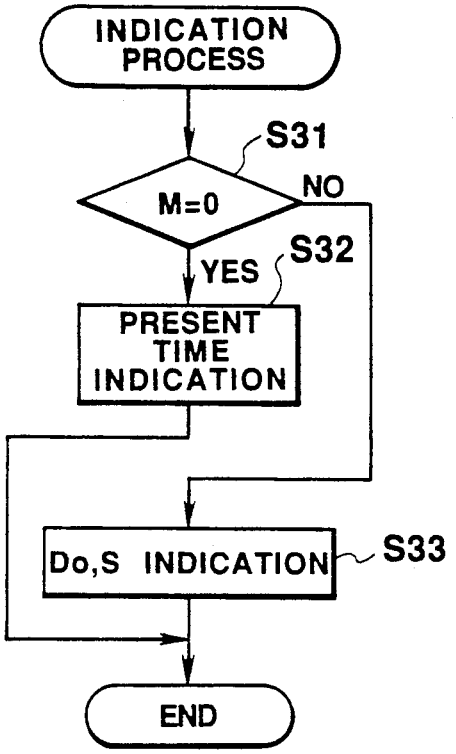

At step S31 of FIG. 11, CPU 23 judges if the mode register M has been set to a value "0". When it is judged that the time indication mode of M=0 has been set, the operation goes to step S32, where the present time data stored in the time counting register T is transferred to the indication register A and then the present time data is indicated in a digital fashion on the dot matrix display section 22.

Figure 12A:
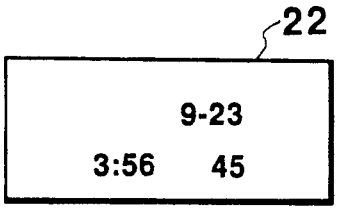

An example of the indication in the time indication mode is shown in FIG. 12A, and date/present time data "3:56:45 September 23" is indicated on the dot matrix display section 22.

When operation of any one of switches 11 to 13 is detected while CPU 23 is in the halt state at step S1 of FIG. 9, the operation goes to step S5, where it is judged if the operated switch is S11.

When it is judged that the switch S11 is operated, the operation goes to step S6, where it is judged if the mode register M has been set to a value "0".

When M=0 is true, i.e., when the switch S11 is operated in the time indication mode to instruct to start measurement of air pressure, the operation goes to step S7, where CPU 23 outputs an opening signal SA, making the air valve 16 open. At the same time, CPU 23 transmits a signal SB to the sensor unit 17 and A/D converter 18, supplying source current thereto to make them start their operation. Then, the time indication mode is switched to the pressure measurement mode, and a value "1" is set to the mode register M at step S9.

When a value "1" is set to the mode register M, the operation goes to step S10 because at step S2 it is judged every receipt of the time counting signal of one second that M=1" is true. At step S10, the register C is incremented by "1" every receipt of the time counting signal. It is judged at step S11 if the counter C has been set to a value "5". When C=5 is true, i.e., when a time interval of 5 seconds lapses, the operation goes to step S12, where the measurement process is performed for measuring air pressure.

The measurement process for measuring air pressure will be described with reference to the flowchart of FIG. 10.

Figure 10:
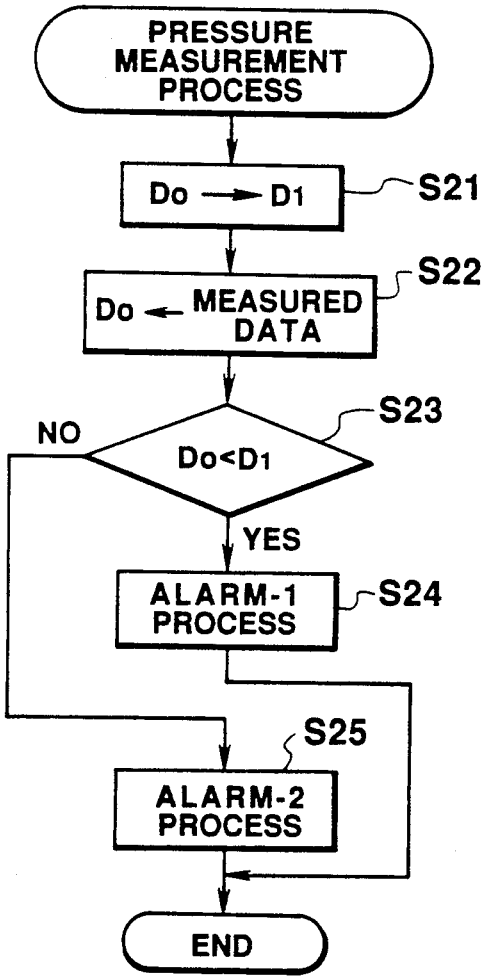

At step S21 of FIG. 10, the last pressure data stored in the register D0 is transferred to the register D1.

At step S22, presently measured pressure data is stored in the register D0.

Pressure data of the register D0 is compared with pressure data of the register D1 at step S23. When D0<D1 is true, i.e., when pressure is decreasing, the operation goes to step 24, where an alarm-1 process is performed, causing the buzzer 25 to generate a predetermined alarm sound.

When it is judged at step S23 that D0=D1 or D0>D1 is true, i.e., when pressure within the air tank 5 is increasing, the operation goes to step S25, where an alarm-2 process is performed, causing the buzzer 25 to generate an alarm sound which is different from that generated in the alarm-1 process.

In the process of adjustment of air pressure within the air tank 5, measurement of air pressure is effected every five minutes, and different alarm sounds are generated when the user is pumping air into the air tank 5, increasing air pressure therein and when he allows air to release from the air tank 5, decreasing air pressure, respectively. Therefore, the user can make sure from the generated alarm sound if air pressure is increasing or decreasing. In addition to the alarm-1 process and alarm-2 process, it may be convenient for the user to modify the embodiment so as to generate the other alarm sound when a substantial coincidence between the values of the registers D0 and D1 is detected.

Referring to FIG. 9, when it is judged that the switch other than the switch S11 has been operated, the operation goes to step S13, where it is judged if the switch S12 has been operated.

When it is judged that the switch S12 has been operated, it is judged at step S14 if the mode register M has been set to a value "1".

When the switch S12 has been operated in the pressure measurement mode of M=1, the most suitable air pressure has been obtained, at which the user's desired cushion and fitness are achieved, and the level of the most suitable air pressure is memorized. Then, the operation goes to step S15, where the pressure data stored in the register D0 is transferred to the pressure data memory S, and thereafter CPU 23 performs the indication process at step S4.

In the pressure measurement mode of M=1, it is judged at step S31 in the indication process of FIG. 11, if the mode register M has been set to a value "0" and the result of the judgment at step S31 is "NO". The operation goes to step S33, where the presently measured pressure data stored in the register D0 and the most suitable air pressure stored in the pressure data memory S are transferred to the indication register A and are indicated on the dot matrix display section 22.

Figure 12B:
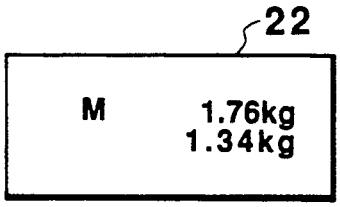

FIG. 12B is a view showing an example of the indication on the dot matrix display section 22. On the upper half portion of the display section 22 the pressure data "1.76 Kg" stored in the pressure data memory S is indicated and on the lower half portion measured pressure data "1.34 Kg" of the register D0 is indicated.

Accordingly, once the user adjusts air pressure to a level at which his desired cushion and fitness are obtained and stores the pressure level (the most suitable air pressure) in the pressure data memory S, the user can easily adjust air pressure to his desired pressure level, watching the indication on the display section 22 because presently measured air pressure data, for example, "1.34 Kg" and the most suitable air pressure as well, for example, "1.76 Kg" stored in the pressure data memory S are indicated on the display section 22 at the same time. Therefore, the user is not required to feel pressure within the air tank 5 with his foot to make a fine adjustment of air pressure therein each time air escapes from the air tank 5. Once adjustment of air pressure has been made, the user can easily adjust thereafter the air pressure for his desired cushion and fitness.

When the switch S11 is operated again after air pressure was adjusted as described above and the adjusted air pressure was stored in the pressure data memory S, it is judged at step S5 of FIG. 9 that the switch S11 has been operated, i.e., the result of the judgment at step S5 is "YES", and it is judged at step S6 that the mode register M has not been set to a value "0", i.e., the result of the judgment at step S6 is "NO". Then, the operation goes to step S16, where CPU 23 instructs the open/close driving section 15 to make the air valve 16 close.

At step S17, the power supply to the sensor unit 17 and A/D converter 18 is made off and the measurement of air pressure is finished. Thereafter, the registers D0 and D1 are cleared, and a value "0" is set to the mode register M and thereby the time indication mode is set.

When the switch S2 is operated in the time indication mode, it is judged at step S13 of FIG. 7 that the switch S13 has been operated, i.e., the result of the judgment at step S13 is "YES" and it is judged at step S14 that the mode register M has not been set to a value "1", i.e., the result of the judgment at step S14 is "NO". Then, the operation goes to step S19, where a selection process for selecting a digit of the time data to be corrected is performed.

When it is judged that the switch S13 has been operated, the result of the judgment at step S13 is "NO". Then, the operation goes to step S20, where the correction process is performed.

In the time indication mode, the switches S12 and S13 are operated for selecting digits to be corrected from date data, time data, minute data and second data and for setting certain numerals to the selected digits to correct time data to be indicated on the display section 22.

Third Embodiment

Figure 13:
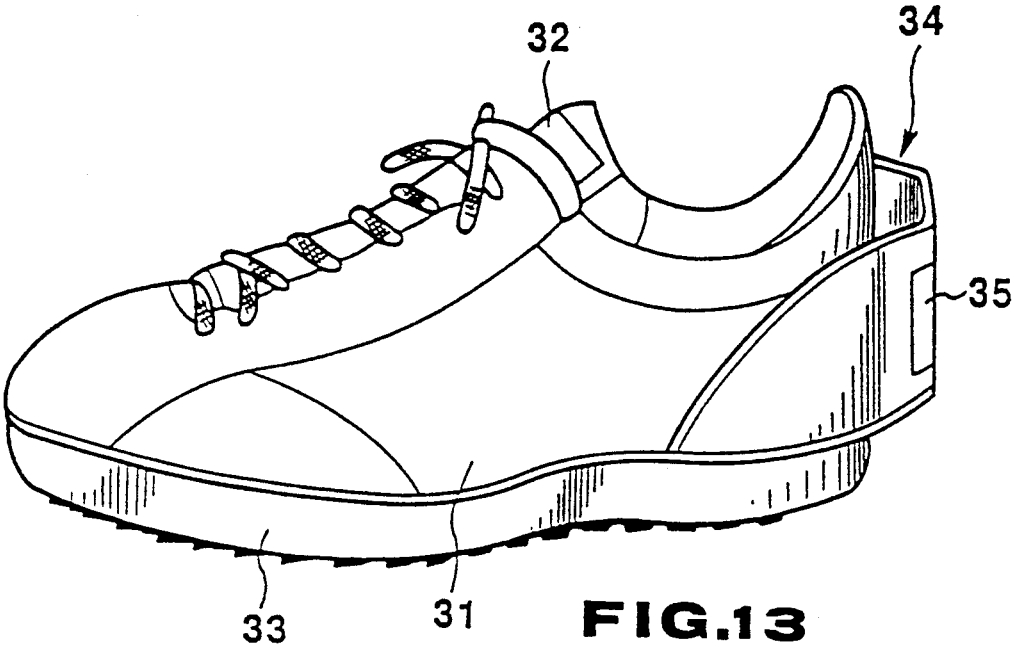
FIGS. 13 to 23 are views showing the third embodiment of the present invention.

The appearance of the shoe according to the third embodiment of the invention is shown in FIG. 13.

As shown in FIG. 13, the shoe comprises an instep 31, a tongue 32, a sole 33 and an outer covering 34 of the heel of the shoe. The outer covering 40 is provided with a transparent portion 35. In side the outer covering 34 there is provided a pressure meter device 40 (not shown in FIG. 13) in the vicinity of the transparent portion 35, and indications of the pressure meter device 40 can be seen through the transparent portion 35.

Figure 14:
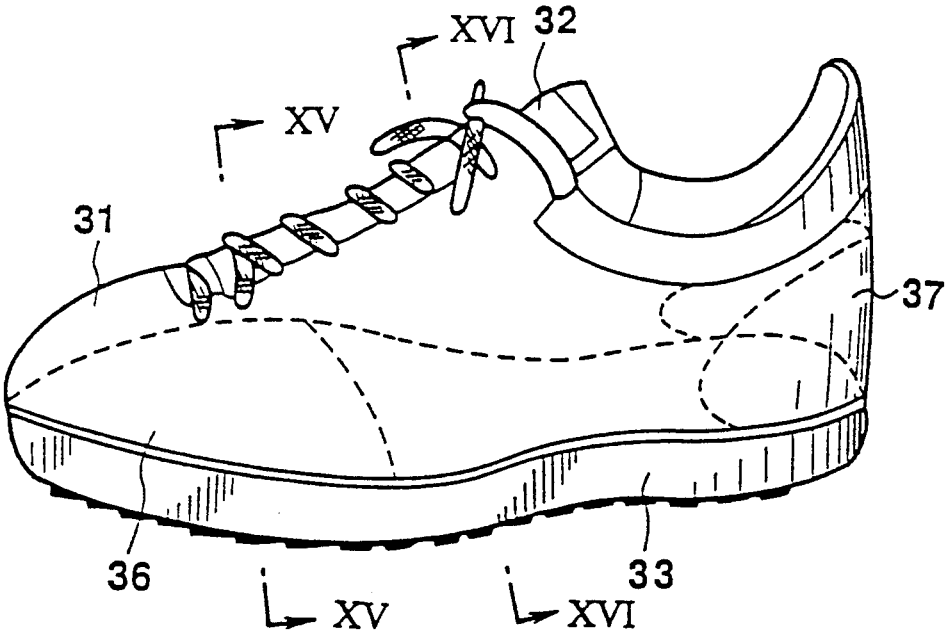
Figure 15:
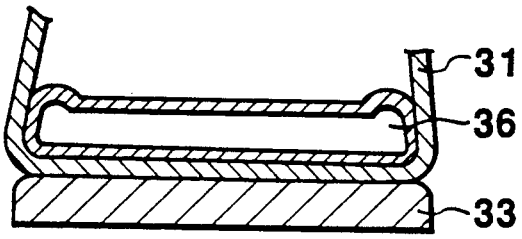
Figure 16:
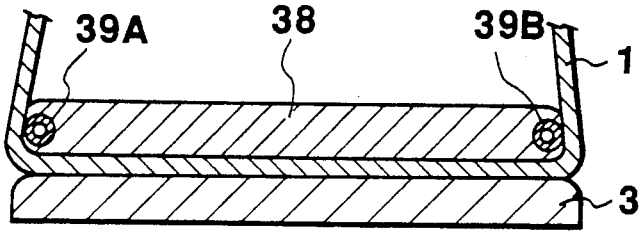

As shown in FIG. 14, there is provided an air tank 36 in the toe of the sole 33 and also there is provided an air tank 37 in a part of the instep 31 covering the heel of the user. The air tank 36 is provided in the toe of the sole 31 as shown in FIG. 15, and it serves as cushion absorbing shocks that may be imposed onto the foot of the user while he is walking or jogging. As shown in FIG. 16, there is provided an under sheet 38 inside the shoe. In the under sheet 38 there are provided air pipes 39A and 39B, by which the air tanks 36 and 37 are connected to each other. In case proper volume of air has been pumped into the air tanks 36 and 37, these air tanks 36 and 37 may absorb shocks imposed onto his foot from the sole of the shoe and may support his instep and heel. At one end of the air pipes 39A and 39B there is provided a pumping valve, to which an external air pump is connected for pumping air into the air tanks 36 and 37.

Figure 17:
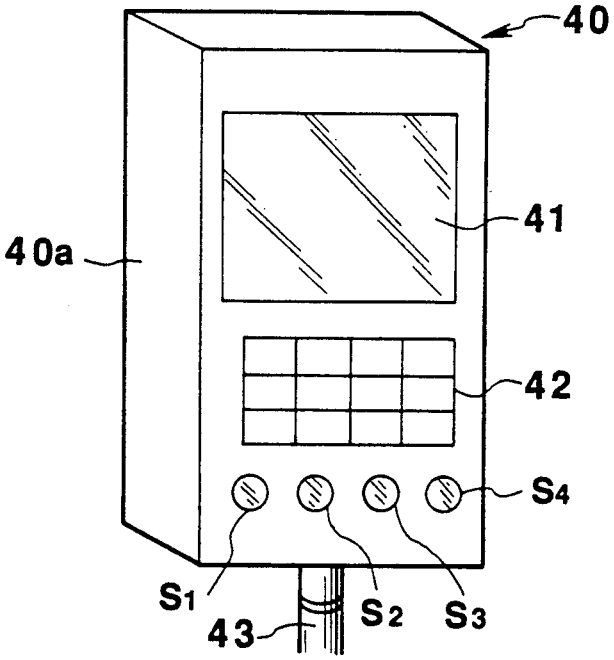

FIG. 17 is a view showing the external appearance of the pressure meter device 40 mounted inside the outer covering 34. As shown in FIG. 17, the pressure meter device 40 is provided on its casing 40*a* with a liquid crystal display section 41 of a dot matrix type for indicating measured pressure data and a present time, and is further provided with a keyboard 42 for inputting characters and numerals, switches S1 to S4, and the air pipe 43 to be connected to the air tanks 36 and 37.

The switch S1 is used for changing the content of the mode register M. The switch S2 is operated at "M =1" to start and/or stop measurement of pressure while it is operated at "M=2" to start and/or measurement of exercise. The switch S3 is used at "M=1" to store measured pressure data in the memory and is used at "M=2" to retrieve the highest pressure data among pressure data stored in RAM 48 and to store the highest pressure data in an exercise data memory of RAM 47. The switch S4 is used at "M=2" to update data to be indicated.

Figure 18:
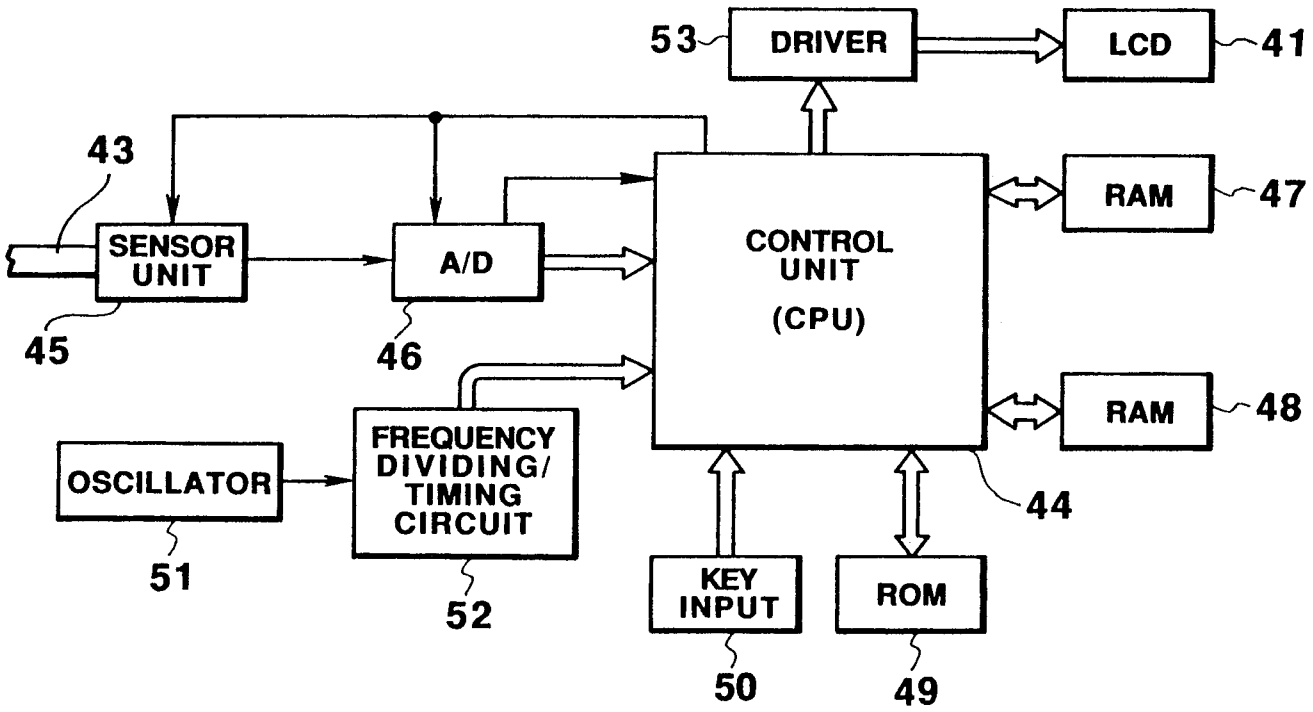

Now, the circuit construction of the pressure meter device 40 will be described with reference to FIG. 18. In FIG. 18, a control unit (CPU) 41 is a central processing unit that performs various processes under control of a micro-program previously stored in ROM 49 such as a measurement process for measuring air pressure within the air tanks 36 and 37, an exercise measurement process and a process for storing data.

A sensor unit 45 includes a pressure sensor which detects air pressure within the air tanks 36 and 37 through the air pipe 43, and outputs an electric signal (detected voltage) representative of the detected air pressure to A/D converter 46.

A/D converter 46 converts the supplied detected voltage into a digital signal and supplies the digital signal to CPU 44. CPU 44 supplies an operation signal N to the sensor unit 45 and A/D converter 46.

Figure 19:
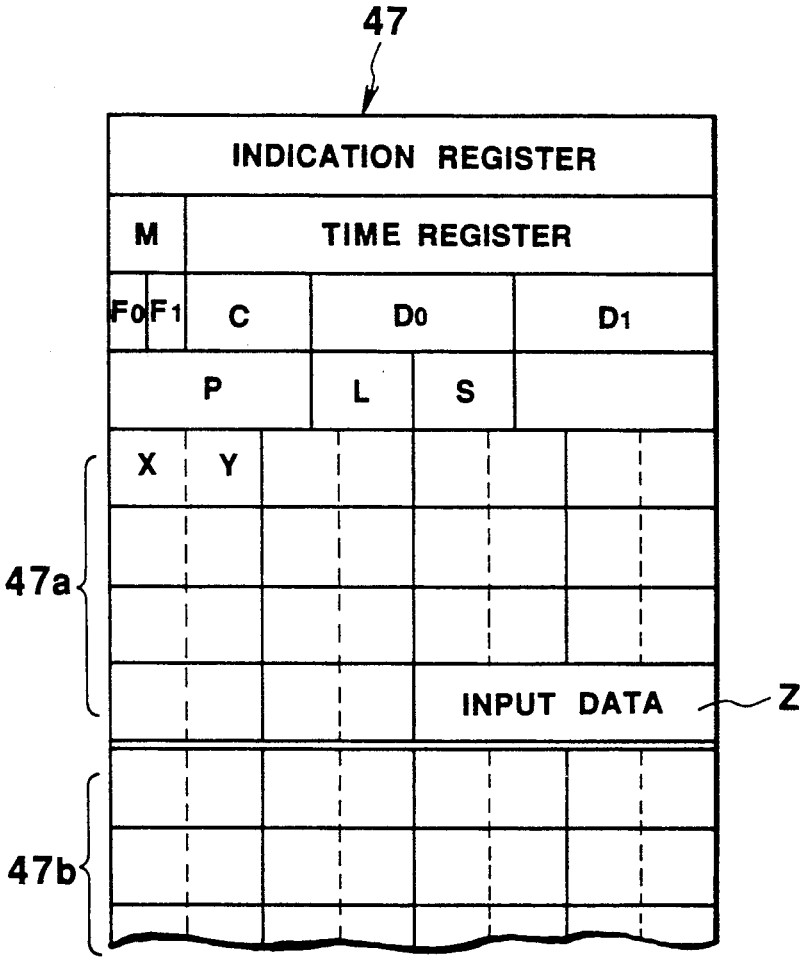

RAM 47 is constructed as shown in FIG. 19 to store various data. In FIG. 19, an indication register serves to store data to be indicated on the liquid crystal display section 41. A mode register M is to store mode data, i.e., it stores "time indication mode" at "M=0", "the most suitable pressure setting mode" at "M=1" and "exercise measurement mode" at "M=2". A time register is to store a present time counted by CPU 44. A flag register F0 is to store a flag instructing to make measurement of air pressure. Flag register F1 is to store a flag instructing to make measurement of exercise. A register C is a register for timer that counts time intervals for pressure measurement and exercise measurement. A register D0 is to store pressure data measured every unit time interval (for example, every 5 sec.). A register D1 is to store a most suitable pressure data that is designated to be set by the user. A register P is a pointer for addressing one of exercise data memories 47*a*, 47*b*, . . . . A register L is to store a state in which the highest pressure data is detected in a data storage process as will be described later. A register S is to count a time interval for comparing pressure data after the highest pressure data has been detected.

The exercise memories 47*a*, 47*b*, . . . are to store exercise data for one trial of exercise, respectively. More specifically, exercise data for the first trial consists of a set of pressure data for the first step taken by the athlete or the user and time data lapsed after he got start, and second exercise data for the second trial consists of the second set of pressure data for the second step taken by him and time data lapsed after the first step, and so on. Each exercise memory comprises a number of memory areas, and each memory area consists of a set of memory area X for storing pressure data and memory area Y for storing the time lapse data. Therefore, sets of pressure data and time lapse data are successively stored in these memory areas. An area Z is for storing input data concerning exercise data (for example, records achieved in the running high jump or running broad jump). Needless to say, RAM 47 is also provided with a work area.

RAM 48 is a memory for successively storing pressure data within the air tanks 36 and 37 sampled at predetermined time intervals, i.e., pressure data sampled in accordance with a sampling signal of 32 Hz.

A key input section 50 comprises a key board 42 and switches S1 through S4, and outputs a key input signal to CPU 44 in response to key input operation.

An oscillator 51 including a quartz oscillator generates a clock pulse signal of 32,768 KHz or its twice. The clock pulse signal is supplied to a frequency dividing-/timing signal generating circuit 52. The frequency dividing/timing signal generating circuit 52 divides the clock pulse signal supplied from the oscillator 51 and generates and supplies CPU 44 with a time counting signal and other various timing signals such as the above sampling signal of 32 Hz.

A driver 53 is supplied with indication data from CPU 44, and outputs an indication driving signal based on the indication data to the liquid crystal display section 41. The liquid crystal display section 41 indicates measured pressure data and a present time.

Figure 20:
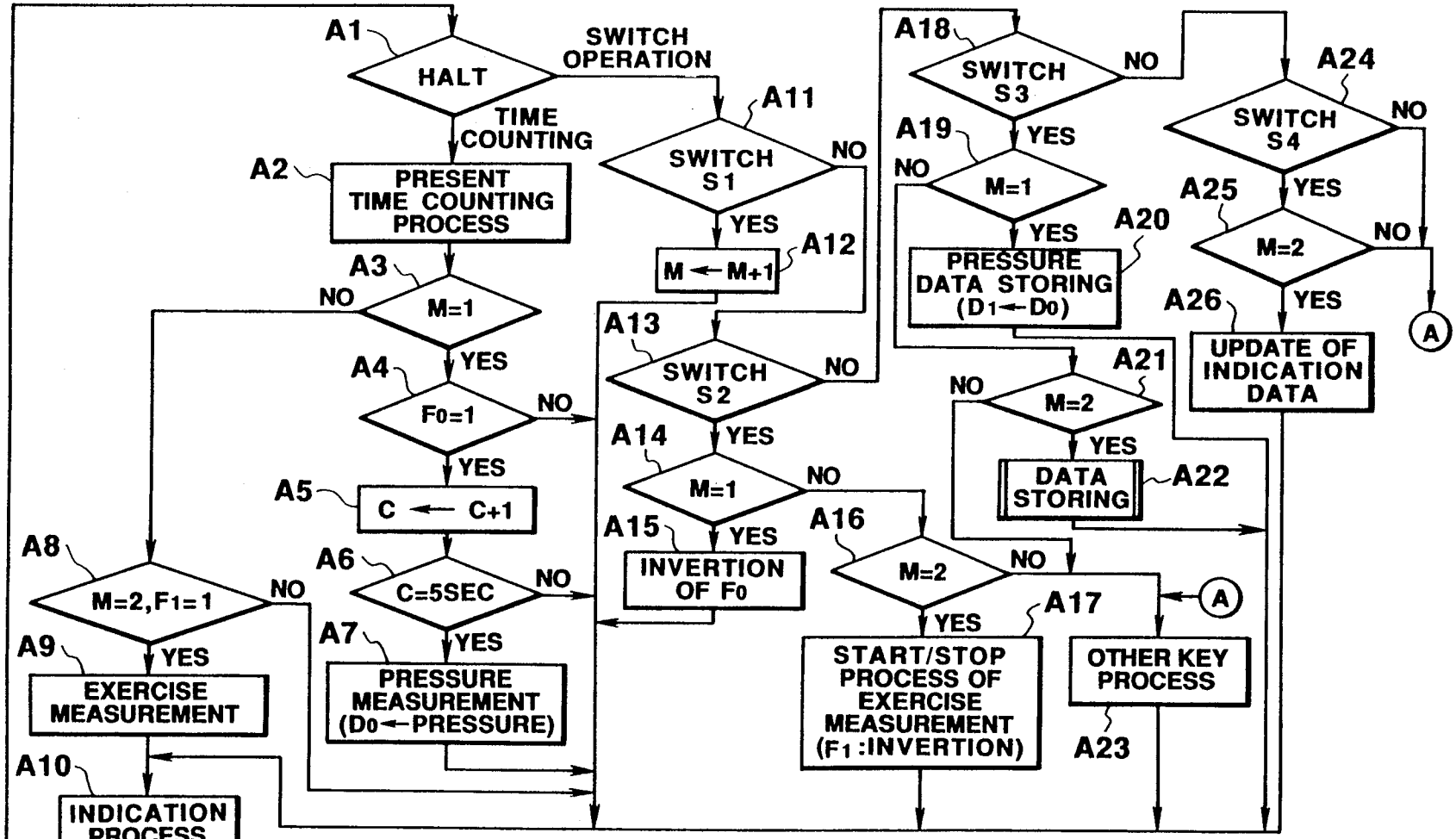
Figure 21:
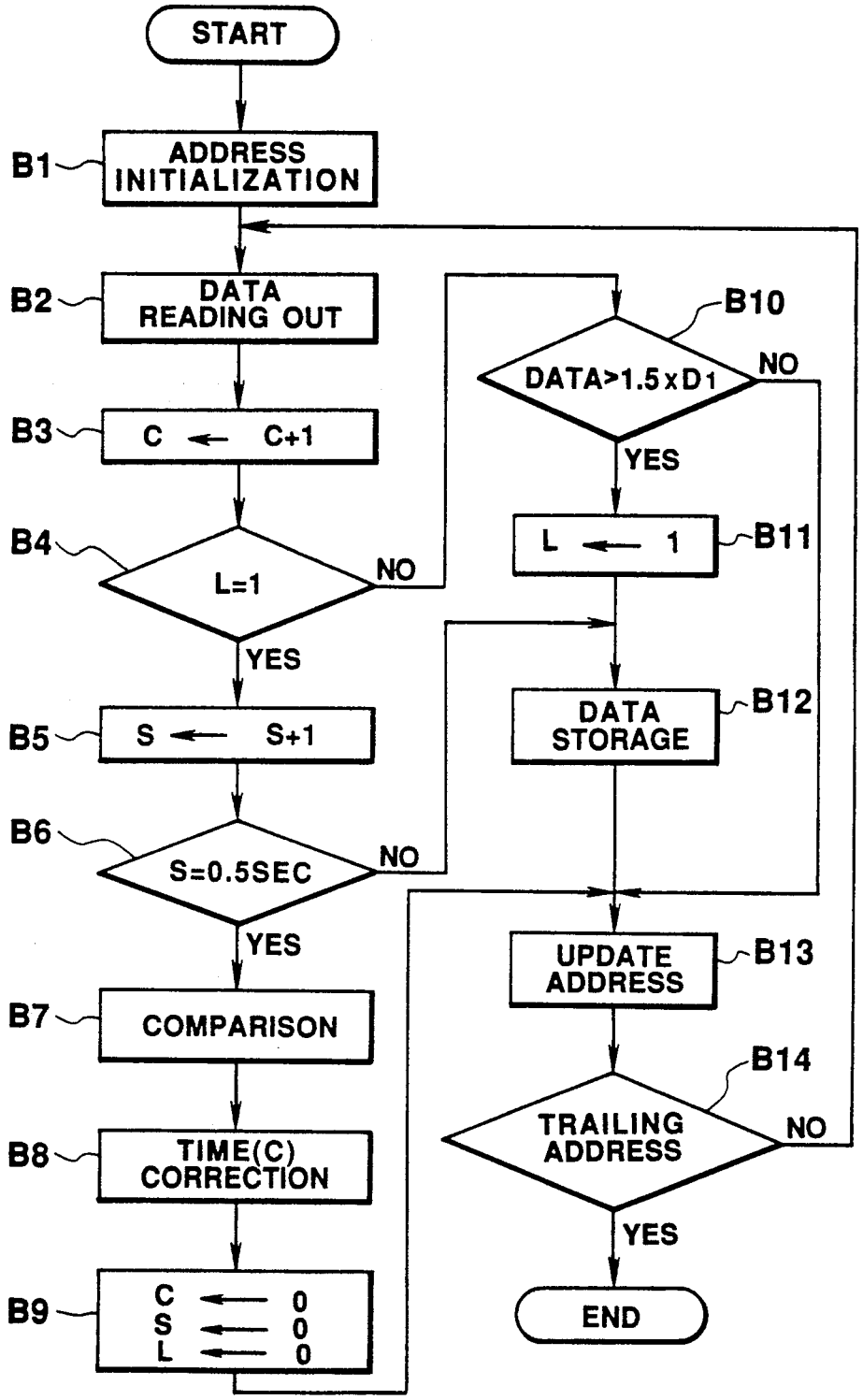

Now, the operation of the third embodiment will be described with reference to the flowchart shown in FIGS. 20 and 21. The flowchart of FIG. 20 shows the whole operation of the embodiment and the flowchart of FIG. 20 shows a data storing process at step A22 of FIG. 20.

In the time indication mode, where the value of the register M is "0", CPU 44 remains in a halt state at step Al until the frequency dividing/timing signal generating circuit 52 generates the time counting signal, for example, of 32 Hz. When the frequency dividing/timing signal generating circuit 52 generates the time counting signal, it is judged at step A1 that the time counting signal has been received, and the operation goes to step A2. In a present time counting process at step A2, the present time data stored in the time counting register is updated. At step A3, it is judged if the mode register M has been set to a value "1", i.e., it is judged if "M=1" is true. When it is judged at step A3 that "M=1" is true, then the operation goes to step A4. Meanwhile, when it is judged at step A3 that "M=1" is not true, the operation goes to step A8. In this case, since "M=1" is not true and "M=0" is true, the operation goes to step A8.

At step A8, it is judged if "M=2 and F1=1" is true, i.e., it is judged if the exercise measuring mode has been set and the measurement for exercise is going on. When the result of the judgment at step A8 is "YES", the operation goes to step A9. Meanwhile, when the result of the judgment at step A8 is "NO", the operation goes to step A10. In this case, since "M=0" is true, the operation goes to step A10. In the indication process at step A10, it is judged that "M=0" is true and present time data "10–23 10 : 35 56 (35 minutes and 56 seconds past 10 o'clock, October 23) is indicated as shown at A of FIG. 22. Then, the operation returns to step A1.

Now, the process for adjusting the air pressure within the air tanks 36 and 37 to the most suitable level will be described. At first, the switch S1 is operated, setting the most suitable pressure level setting mode of "M=1". Then, the switch S2 is operated to start measurement of air pressure within the air tanks. Then, the user pumps air into the air tanks 36 and 37 with the air pump, watching the indication on the liquid crystal display section 41. When the most suitable pressure level is reached and indicated on the liquid crystal display section 41, the user operates the switch S3, storing the indicated pressure data into the register D1.

More specifically, when the switch S1 is operated, it is judged at step A1 that an input from a switch has been received, and the operation goes to step A11, where it is judged if the switch S1 has been operated. In this case, it is judged that the switch S1 has been operated and the result of the judgment is "YES", and then the operation goes to step A12, where CPU 44 increments the content of the mode register M by "+1", setting the most suitable pressure level setting mode. After step A12, the operation goes to the indication process at step A10, where it is judged that "M=1" is true, and, for example, the most suitable pressure data "1.90 Kg" stored in the register D1 and the presently measured pressure data "1.45 Kg" stored in the register D0 are indicated at the same time as shown at B of FIG. 22.

To start measurement of air pressure, the switch S2 is operated. Then, similarly the operation advances from step A1 to step A11. At step A11, since the switch S2 has been operated, it is judged that the switch S1 has not been operated, i.e., the result of the judgment is "NO". Then, the operation goes to step A13, where it is judged if the switch S2 has been operated. Since the switch S2 has been operated, the result of the judgment at step A13 is "YES". The operation goes to step A14.

At step A14, it is judged if "M=1" is true, similarly at step A3. When it is judged that "M=1" is true, i.e., the result of the judgment is "YES", the operation goes to step A15. Meanwhile, when the result of the judgment at step A14 is "NO", the operation goes to step A16. In this case, as "M=1" is true, the operation goes to step A15.

At step A15, the content of the flag register F0 is inverted. Since the flag register F0 is set to the initial state, i.e., to a value "0", it is inverted to "F0=1" and the flag for measurement of pressure is set. Finishing the process at step A15, CPU 44 goes to step A10. Then, CPU 44 remains in the halt state until it receives the time counting timing signal.

Now, it is assumed that the time for the time-counting is reached, when the air is pumped into the air tanks from the air pump while CPU 44 is in the halt state. Then, CPU 44 advances from step A1 to step A3. At step A3, CPU 44 judges that "M=1" is true, and further goes to step A4.

At step A4, it is judged if the content of the flag register F0 is "1". Since "F0=1" is set at step A15, the result of the judgment at step A4 is "YES", and the operation goes to step A5. At step A5, the content of the register C is incremented by "+1" and a time interval between the measurements air pressure is measured.

At the following step A6, it is judged if the content of the register C reaches a value corresponding to "5 seconds". More specifically, to effect measurement for air pressure every 5 seconds in the present embodiment, the register C counts a time interval for measurements. Since the register C is incremented by "+1" every generation of the signal of 32 Hz, a time interval of "5 seconds" is equivalent to a time interval during which a value of the register C reaches "160". When it is judged at step A6 that a time interval of "5 seconds" has not yet lapsed, i.e., when the result of the judgment at step A6 is "NO", the operation returns to step A1 through step A10. Then, CPU 44 repeats the processes at steps A1 though A6 and step A10. When the content of the register C reaches a value corresponding to "5 seconds", the result of the judgment at step A6 will be "YES" and the operation goes to step A7.

At step A7, air pressure within the air tanks 36 and 37 is measured and obtained pressure data are stored in the register D0. More specifically, CPU 44 supplies a signal N of a level of "1" to the sensor unit 45 and A/D converter 46 to make them work. Then, the sensor unit 45 generates and supplies a sensor voltage to A/D converter 46. A/D converter 46 converts the supplied sensor voltage into a digital signal and supplies the same to CPU 44. CPU 44 stores the digital signal in the register D0 of RAM 47. CPU 44 goes to the indication process at step A10. In the indication process at step A10, the most suitable pressure data "1.90 Kg" stored in the register D1 and measured pressure data "2.12 Kg" stored in the register D0 are indicated.

Then, the user adjusts air pressure within the air tanks 36 and 36 by pumping or releasing air therefrom, and operates the switch S3 when the most suitable pressure level is obtained for or supporting his foot in a comfortable state.

Now, the operation goes from step A1 to step A11. At step A11 it is judged that the switch S1 has been operated. Further, it is judged at step A11 that the switch S2 has been operated. Then the operation goes to step A18, where it is judged if the switch S2 has been operated. Since the switch S3 has been operated, it is judged at step A18 that the switch S3 has been operated and the operation goes to step A19.

At step A19 it is judged if "M=1" is true. Since "M=1" has been set, the result of the judgment at step A19 is "YES" and the operation goes to step A20, where data stored in the register D0 is stored in the register D1 as the most suitable pressure data. Now, the operation goes to step A10 and as a result other suitable pressure data is held in the memory.

To measure the force of each step taken by the athlete (the user) in an entrance interval and a time taken by him in the entrance interval in a running high jump or running long jump and to memorize these data in a memory, an exercise measurement mode is set by operating the switch S1. Then, the operation goes from step A1 to step A11, where it is judged that the switch S1 has been operated, and further goes to step A12, where the mode register M is incremented by "+1", and as a result the exercise measurement mode of "M=2" is set.

To make the operation of measurement start, the switch S2 is operated. Similarly, the operation goes through steps A1, A11, A13 and A14 to step A16, where it is judged if "M=2" is true. It is judged that the result of the judgment at step A is "YES" and the operation goes to step A17, where a start/stop process of the exercise measurement is performed. In the start/stop process of the exercise measurement, the content of the flag register F1 is transferred from "0" to "1". Finishing the start/stop process of the exercise measurement at step A17, CPU 44 goes to the indication process at step A10, where a message "START !" is displayed to indicate the start of the exercise measurement as shown at D of FIG. 22.

Thereafter, "M=2, F1=1" has been set and the exercise measurement starts. CPU 44 goes to the exercise measurement process at step A9 through steps A3 and A8 every time a time-counting time is reached. That is, the exercise measurement process is performed every sampling times of 32 Hz.

In the exercise measurement process, air pressure within the air tanks 36 and 37 are measured by the sensor unit 45 and the measured pressure data are successively stored in RAM 48. Accordingly, pressure data are sampled in synchronism with the sampling-timing of 32 Hz and are successively stored in RAM 48.

To stop the exercise measurement after the athlete finishes the first trial of the running high jump or running long time, the switch S2 is operated again. Then, the operation goes to step A16 through steps A1, A2. A13 and A14. At step A16, it is judged that "M=2" is true, and the start/stop process for the exercise measurement is performed again at step A17 and the value of the flag register F1 is converted from "1" to "0", finishing the exercise measurement. Then, the operation goes to step A10.

When the switch S3 is operated, a data storing process is performed, in which data such as the force of every steps and a time taken by the athlete in the entrance interval. The operation of the switch S3 advances the operation from step A1 to A11. CPU 44 judges that the results of the judgment at steps A11 and A13 are "NO", respectively and goes to step A18. Since the switch S3 has been operated, it is judged as "YES" at step A18 and the operation goes to step A19, where it is judged if "M=1" is true. Since "M=2" is true, it is judges as "NO" and the operation goes to step A21, where it is judged if "M=2" is true. In this case, it is judged as "YES" and the operation goes to the data storing process at step A22.

Now, the data storing process will be described in detail with reference to the flowchart of FIG. 21. At B1, an address pointer of RAM 48 (not shown) is initialized and a register C (not shown) is cleared. The initialization of the address pointer of RAM 48 points the leading address of the RAM 48. At step B2, pressure data at the address pointed by the address pointer is read out from RAM 48. The content of the register C is incremented by "+1" at step B3. The register C serves as a register for counting a time required to take another step.

It is judged at step B4 if the content of the register L is "1". Since the content of the register L is "1", CPU 44 judges as "NO" at step B4 and goes to step B10.

To measure pressure data caused by steps taken by the user while he is walking, it is judged at step B10 if the read out pressure data is larger than 1.5 times the content (the most suitable pressure data) of the register D1. When the result of the judgment at step B11 is "YES", the operation goes to step B11, and When the result of the judgment at step B11 is "NO", then the operation goes to step B13. In this case, while the user lifts his foot, i.e., while his foot is not on the ground, the pressure is substantially equivalent to the most suitable pressure data or less. Therefore, CPU 44 judges as "NO" at step B10O, and goes to step B13. At step B13, the content of the pointer P is updated and the following pressure data in RAM 48 is designated.

At step B14, it is judged if the content of the pointer P points the trailing address of RAM 48. Since the trailing address is not reached at present, CPU 44 judges as "NO" and returns to step B2.

Thereafter, CPU 44 repeatedly performs the processes at steps B2 to B4, B10 and B13 until CPU 44 judges as "YES" at step B10.

When pressure data which is equivalent to 1.5 times the most suitable pressure data is read out from RAM 48, this pressure data is deemed as pressure data at the time the user has just taken a step. Therefore, CPU 44 judges as "YES" at step B10, and goes to step B11. At step B11, a value "1" is written into the register L and the fact is memorized that the pressure data at a step taken by the user has been read out. At the following step B12, the read out pressure data is temporarily stored in a work area (not shown) of RAM 47. The register C has counted the number of pressure data that were successively stored in RAM 48 at the rate of 32 Hz, and thereby it shall memorize time data required until the pressure data higher than 1.5 times the most suitable pressure data is read out. Then, the operation returns to step B2 through steps B13 and B14. When the operation goes through steps B2 and B3 to step B4, it is judged as "YES" as "L=1" is true and the operation goes to step B5. At step B5, the content of the register S is incremented by "+1" and a time interval is counted for comparing pressure data obtained within a certain time interval (0.5 sec). At step B6, it is judged if the content of the register S is equivalent to a time interval of 0.5 sec. When the result of the judgment at step B6 is "YES", the operation goes to step B7. Meanwhile, when the result of the judgment at step B6 is "NO", the operation goes to step B12.

Thereafter, processes at steps B2 though B6 and steps B12 through B14 shall be repeatedly performed in a similar manner as described above, temporarily storing pressure data and the contents of the register C as well in the work area, until it is judged as "YES" at step B6, i.e., until the content of the register S reaches "0.5 sec." When the content of the register S reaches 0.5 sec. and it is judged as "YES" at step B6, the operation goes to step B7.

At step B7, to detect the highest pressure data, the pressure data stored in the work area are compared with each other, i.e., pressure data are compared which shall be obtained within the time interval of 0.5 sec. after the pressure data of 1.5 times the most suitable pressure data or higher has been detected at step B10. More specifically, since the pressure data of 1.5 times the most suitable pressure data or higher is not always the highest pressure data at step taken by the athlete, the pressure data obtained within the time interval of 0.5 sec. are compared with each other to detect the highest pressure data among them. At step B8, it is judged what time within the time interval of 0.5 sec. the detected highest pressure data has been detected, and time data representative of time lapses between steps stored in the register C is corrected. Now, the highest pressure data and time data stored in the register C are written as "data for the first step" into an exercise data memory 47*a* of RAM 47.

At the following step B9, a value "0" is written into the registers C, S and L and thereby these registers are cleared, and the operation goes to step B13. Similarly, address is updated at step B13, and when it is judged at step B14 that the trailing address is not reached, the operation returns to step B2.

At step B2, pressure data is read out from RAM 48 in accordance with the designation of the pointer P, and the register C is incremented by "+1" at step B3.

It is judged at step B4 if "L=1" is true. As "L =0" has been set, it is judged as "NO" at step B4, and the operation goes to step B10, where it is judged if the read out pressure data is pressure data for the second step taken by the athlete. Thereafter, the processes at steps B2 through B4, B10 and B13 are repeatedly performed, detecting the pressure data for the step taken by the athlete until it is judged at step B10 as "YES".

When pressure data ( for the second step) of 1.5 times the most suitable pressure data or higher is read out from RAM 48, it is judged as "YES" at step B10 and the operation goes to steps B11 and B12. Similarly, pressure data obtained in the time interval of 0.5 sec. are temporarily stored in the work area until it is judged as "YES" at step B6. At step B7, the highest pressure data for the second step of the athlete is detected. At step B8, time data of the register C is corrected, and the highest pressure data and the corrected time data are written into the exercise data memory 47*a* of RAM 47 as "data for the second step".

Data for the third step taken by the athlete and data for steps thereafter are similarly processed. When the pointer is successively updated, designating the trailing address, and it is judged as "YES" at step B14, then the data storing process is finished and the operation goes to step A10.

When the athlete finished his first trial of the running high jump, clearing the height of "1.70 m", and the pressure data and time data for the first trial were stored in the memory 47*a*, numerical data "1.70 (m)" can be added to these data. In this case, numerical data "1.70" are entered one by one to a digit or position which is ready for entrance of the numerical data and on which a cursor is displayed in a blinking fashion, as shown at G of FIG. 22. In FIG. 20, the operation advances from step A1 through steps A11, A13 and A18 to step A24, where it is judged as "NO". At step A23, the input numerical data "1.70" is memorized in an input data area Z in the exercise data memory 47*a* of RAM 47.

Finally, an operation will be described for successively indicating exercise data stored in RAM 47. In the exercise measurement mode of M=2 shown in FIG. 22, the switch S4 is operated. When the switch S4 is operated, the operation goes from A1 through steps A11, A13 and A18 to step A24 in FIG. 20, where it is judged as "YES". Then, the operation goes to step A25, where it is judged if "M=2" is true. The result of the judgment is "YES", and the operation goes to step A26.

Figure 22:
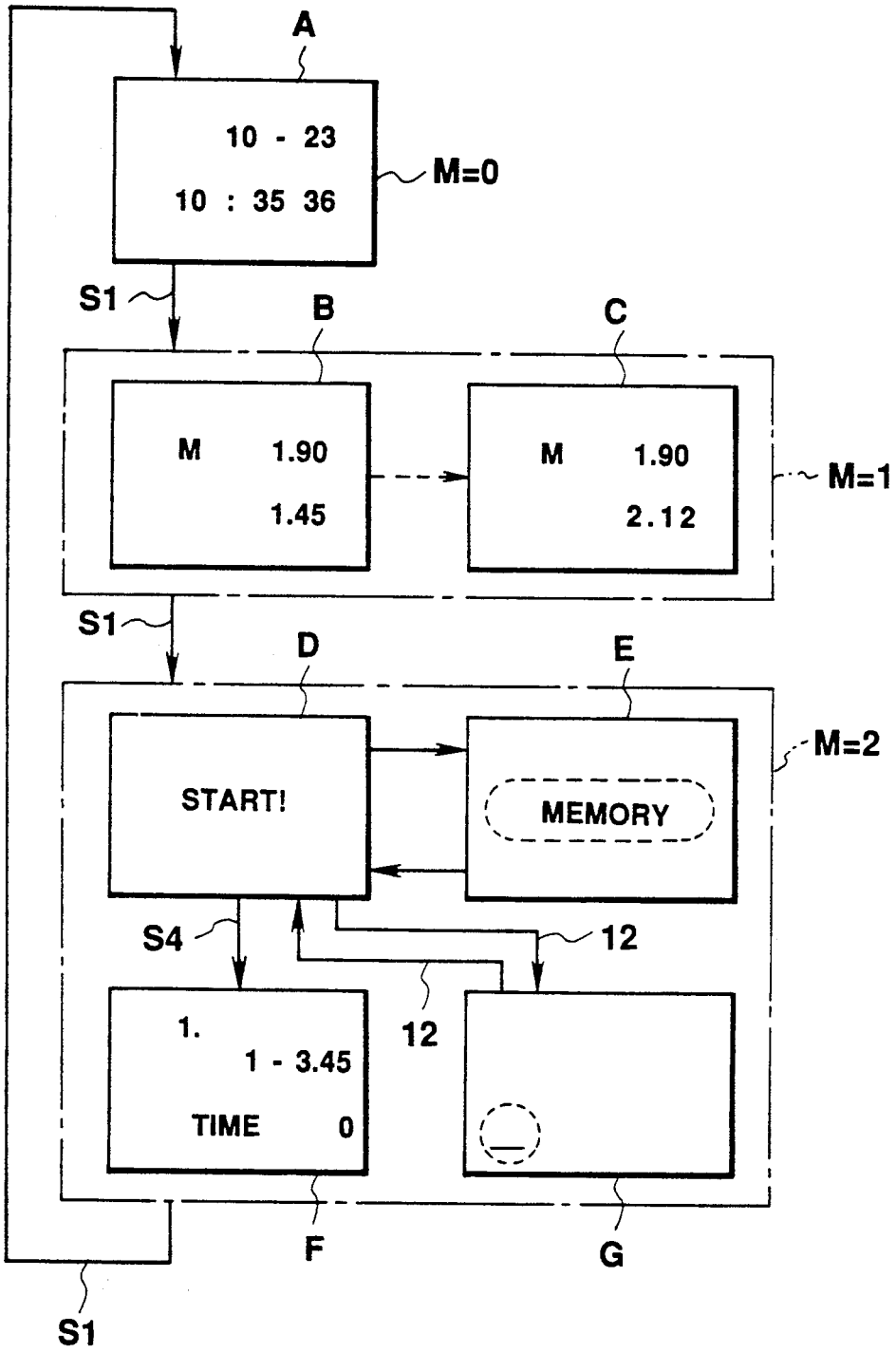

In the indication-data updating process at step A26, the address pointer P of RAM 47 is updated every operation of the switch S4, and the pressure data "3.45 Kg" for the first step is read out from the exercise data memory 47*a* and is indicated as shown at F of FIG. 22. The pressure data "3.56 Kg" for the second step and time data "0.63 sec." representative of a time lapse between the first and second step are shown at A of FIG. 23.

Figure 23:
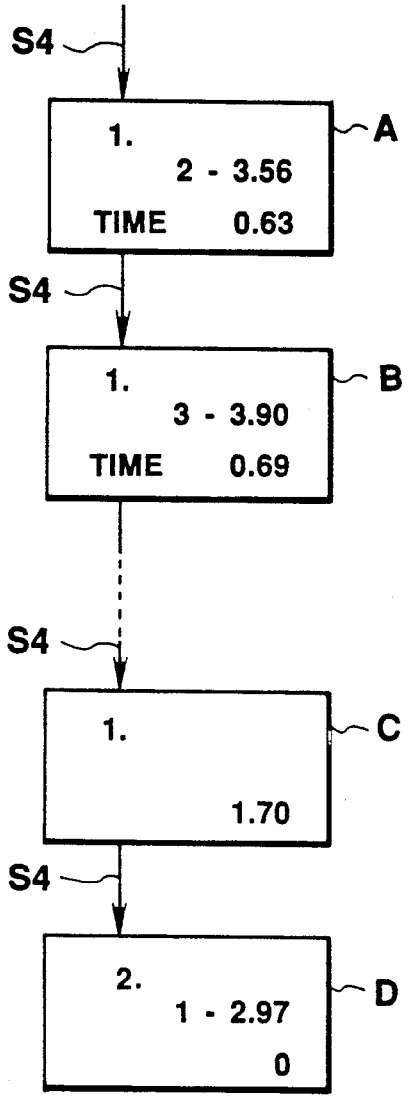

Further, when the switch S4 is operated, the indication-data updating process at step A26 is performed again, and the pressure data "3.90 Kg" for the third step and time data "0.69 sec." representative of a time lapse between the second and third step are read out and indicated respectively as shown at B of FIG. 23.

When the switch S4 is further successively operated, data for the forth and fifth step are read out and indicated, and finally the numerical data "1.70 (m)" set in the input data area Z is indicated as shown at C of FIG. 23.

Another operation of the switch S4 allows the pressure data "2.97 (Kg)" and time data "0 (sec.)" for the first step of the second trial stored in the exercise data memory 47*a* of RAM 47 to be indicated.

In the above embodiments, not only the most suitable pressure data can be easily set, but also exercise data and time data can be measured with reference to the previously set most suitable pressure data.

Figure 24:
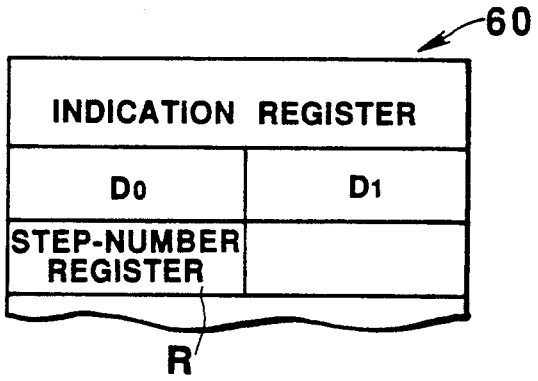
FIG. 24 is a view showing a construction of RAM 60 used in yet other embodiment.
Figure 25:
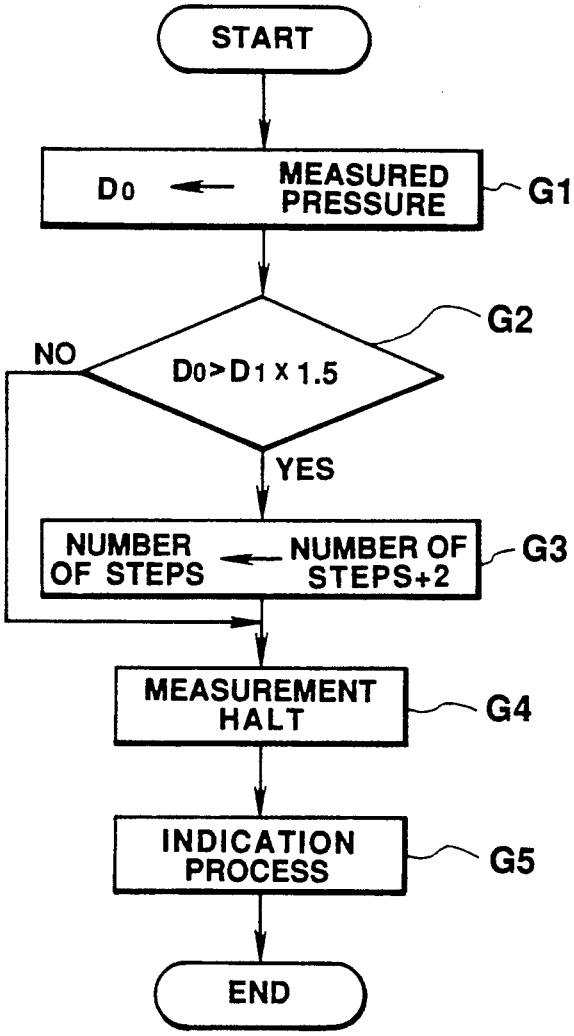
FIG. 25 is a flowchart of operation of the yet other embodiment.

In the third embodiment, time data representative of a time lapse between steps taken by the athlete and pressure data at each step taken by the athlete are measured, but the third embodiment may be used as a pedometer, as shown in FIGS. 24 and 25, for measuring amount of exercise conducted by the user such as the number of steps taken by him and the approximate distance he walks.

FIG. 24 is a view showing the construction of RAM 60 which is used in place of RAM 47 of FIG. 18. RAM 60 comprises an indication register, a register D0 for storing measured pressure data, a register D1 for storing a set most suitable pressure data and a register R for storing step-number data. The indication register, register D0 and register D1 are the same as those of RAM 47.

The number of steps taken by the user is measured in the process shown in FIG. 25. More specifically, the process of FIG. 25 is performed every one 16th seconds to measure the number of steps. The process at step G1 is for measuring pressure within the tank chambers, and measured pressure data is stored in the register D0. At step G2, it is judged if the pressure data stored in the register D0 is equivalent to 1.5 times the most suitable pressure data or higher. When the pressure data stored in the register D0 is equivalent to 1.5 times the most suitable pressure data or higher, the operation goes to step G3, where a value "2" is added to the step-number data stored in the register R. More specifically, when it is judged that the pressure data stored in the register D0 is equivalent to 1.5 times the most suitable pressure data or higher, it is deemed that the user has taken one step with his foot with the shoe put on. Then, the user must have taken another step with his other foot and a value "2" is added to the number of steps. At step G4, a process is performed for suspending measurement of pressure for a certain period, for instance, for a period of 0.5 sec. More specifically, once it has been judged that the pressure data stored in the register D0 is equivalent to 1.5 times the most suitable pressure data or higher, the pressure data which is detected within a certain period thereafter and which is 1.5 times the most suitable pressure data or higher is deemed and processed as pressure data for the same step taken by the user. At step G5, the step-number data stored in the register R is indicated as data representative of amount of exercise.

Though not shown, the embodiments of the invention may be provided with an operation circuit, and data such as the user's weight, age and sex in addition to the step-number data are entered into the operation circuit by key operation. The operation circuit may calculate consumed calorie using these entered data. The calculated consumed calorie may be indicated as data representative of amount of exercise.

Furthermore, a pace and step-number data may be entered to the operation circuit for calculating a distance he walked. The calculated distance may be indicated as data representative of amount of exercise. If the embodiments of the invention are arranged to measure a time required by the user to walk a certain distance, a walking velocity may be indicated as data representative of amount of exercise conducted by the user. As described above, various data representative of amount of exercise conducted by the user may be obtained by measurement of pressure imposed on the user's foot. For example, these data may be data representative of hardness of exercise or aerobics points. The invention shall not be limited to the particular details of the construction of the above embodiments.

In the first to third embodiment, gas filled into the tank chambers of the footwear is not always air but other gas such as carbon dioxide gas may be used. The construction of the tank chambers and tubes connecting the tank chambers shall not be limited to that of the embodiments. Further, the disposition of the air pump and pressure meter device within the footwear shall not be limited to that in the embodiments.

Modification may be made such that the air pump is not mounted inside the footwear but only the inlet valve member is mounted to permit air to be pumped thereto from an external air pump. Further, the inlet valve member is mounted on the footwear but the pressure meter device may be detachably mounted on it only while the user conducts an exercise or air is pumped thereto.

Furthermore, the measured pressure data and the stored most suitable pressure data may be indicated in a digital fashion or in an analog fashion as well.

Yet furthermore, the present invention may be used in various shoes or boots such as leather shoes, sport shoes, mountaineering boots, golf shoes and ski boots.

Embodiments have been described in which the invention is applied to only a right or left shoe of shoes but the invention may be applied to both shoes. In the third embodiment, pressure data stored in RAM 48 may be graphically indicated with time on the X-axis and pressure on the Y-axis. The user can precisely confirm the applied forth from the above graphical indication.

What is claimed is:

1. A footwear comprising:

a tank member formed inside said footwear, to be in contact with a foot of a user, and for applying a pressure to said foot of said user;

air pumping means for externally filling said tank member with air;

pressure measuring means, mounted on said footwear, for measuring an air pressure within said tank member, when said tank member is filled with air by said air pumping means, to obtain pressure data;

pressure data storing means for storing said pressure data obtained by said pressure measuring means; and pressure data indicating means for indicating said pressure data measured by said pressure measuring means and said pressure data stored in said pressure storing means.

2. A footwear according to claim 1, wherein said tank member comprises a flexible material.

3. A footwear according to claim 1, wherein said tank member is positioned inside said footwear to be in contact with a part of at least one of a toe, an instep and an ankle of said user.

4. A footwear according to claim 1, wherein said pressure measuring means, said pressure data storing means and said pressure data indicating means are detachably mounted on said footwear.

5. A footwear according to claim 1, further comprising:

externally operable switch means adapted to be operated to cause said pressure measuring means start an operation for measuring an air pressure within said tank member; and timer means responsive to said operation of said externally operable switch means for causing said pressure measuring means to perform an operation for measuring said air pressure within said tank member after at least a given time interval.

6. A footwear according to claim 1, wherein said pressure data indicating means comprises digital display means for digitally indicating said pressure data measured by said pressure measuring means and said pressure data stored in said pressure data storing means.

7. A footwear according to claim 1, wherein said air pumping means comprises:

a valve member provided on apart of said tank member; and wherein:

said valve member is connectable with an external air pump for allowing air to be pumped into said tank member.

8. A footwear according to claim 1, wherein:

said air pumping means comprises an air pump mounted on said footwear; and said air pump is connected with said tank member.

9. A footwear according to claim 1, further comprising:

comparing means for comparing pressure data measured by said pressure measuring means with pressure data stored in said pressure data storing means; and announcing means for announcing a result of said comparison made by said comparing means.

10. A footwear according to claim 1, further comprising:

time counting means for counting a present time; and indication control means for controlling said pressure data indicating means to indicate said present time counted by said time counting means.

11. A footwear according to claim 1, further comprising externally operable switch means for causing said pressure data storing means to store pressure data obtained by said pressure measuring means.

12. A footwear comprising:

a tank member formed inside said footwear, to be in contact with a foot of a user, and for applying a pressure to said foot of said user;

pressure measuring means, mounted on said footwear, for measuring an air pressure within said tank member to obtain pressure data;

pressure data storing means, mounted on said footwear for storing a plurality of said pressure data obtained by said pressure measuring means in accordance with a foot motion by said user; and pressure data indicating means for indicating said plurality of pressure data stored in said pressure data storing means.

13. A footwear according to claim 12, further comprising pressure changing means for changing an air pressure within said tank member by permitting air to be pumped into said tank member.

14. A footwear according to claim 12, further comprising:

time data storing means for storing time data representative of a plurality of times at which said plurality of pressure data were respectively stored in said pressure data storing means; and indication control means for controlling said pressure data indicating means to indicate said time data stored in said time data storing means.

15. A footwear according to claim 12, wherein said tank member comprises a flexible material.

16. A footwear according to claim 12, wherein said tank member is positioned inside said footwear to be in contact with at least one of a toe, an instep and an ankle of said user.

17. A footwear according to claim 12, wherein said pressure measuring means, said pressure data storing means and said pressure data indicating means are detachably mounted on said footwear.

18. A footwear according to claim 12, wherein said pressure measuring means performs a measurement of pressure at given time intervals.

19. A footwear comprising:

a tank member formed inside said footwear, to be in contact with a foot of a user, and for applying pressure to said foot of said user;

pressure measuring means, mounted on footwear, for measuring an air pressure within said tank member to obtain pressure data;

still pressure data storing means mounted on said footwear, for storing pressure data obtained by said pressure measuring means while said foot of said user is not moving; and means, mounted on said footwear, for obtaining a plurality of exercise-volume data from a pressure obtained by said pressure measuring means in accordance with afoot motion by said user and said pressure data stored in said still pressure data storing means.

20. A footwear according to claim 19, further comprising indicating means for indicating said plurality of exercise-volume data.

21. A footwear according to claim 19, further comprising pressure changing means for changing an air pressure within said tank means by permitting air to be pumped into said tank member.

22. A footwear according to claim 19, wherein said tank member comprises a flexible material.

23. A footwear according to claim 19, wherein said tank member is positioned inside said footwear to be in contact with at least one of a toe, an instep and an ankle of said user.

24. A footwear according to claim 19, wherein said means for obtaining said plurality of exercise-volume data comprises:

detecting means for making a determination whether said pressure data measured by said pressure measuring means in accordance with said foot motion by said user represents a pressure that is greater than a pressure represented by said pressure data stored in said still pressure data storing means; and step-number counting means for obtaining step-number data that is representative of a number of steps taken by said user from the determination made by said detecting means.

25. A footwear according to claim 19, further comprising:

indicating means for indicating step-number data that is representative of a number of steps taken by said user.

26. A footwear comprising:

a tank member formed inside said footwear so as to be in contact with a part of at least one of a toe, an instep and an ankle of a user, and for applying a pressure to said part of at least one of said toe, said instep and said ankle of said user;

air pumping means for externally filling said tank member with air;

pressure measuring means, mounted on said footwear, for measuring an air pressure within said tank member, when said tank member is filled with air by said air pumping means, and for generating a pressure signal; and pressure data indicating means, mounted on said footwear, for indicating pressure data that corresponds to said pressure signal generated by said pressure measuring means.

27. A footwear according to claim 26, wherein said pressure data indicating means is detachably mounted on said footwear.

28. A footwear according to claim 26, further comprising externally operable switch means for causing said pressure measuring means to start a measuring operation for measuring said air pressure within said tank member.

29. A footwear according to claim 26, wherein:

said pressure data indicating means comprises a plurality of indicating members; and said pressure data indicating means converts said pressure signal into digital data that indicates said pressure data with said plurality of indicating members.

30. A footwear according to claim 26, further comprising timer means for causing said pressure measuring means to perform an operation for measuring said air pressure within said tank member, after at least a given time interval.

31. A footwear according to claim 26, wherein:

said air pumping means comprises a valve member provided on a part of said tank member; and said valve member is connectable to an external air pump for allowing air to be pumped into said tank member.

32. A footwear according to claim 26, wherein said air pumping means comprises an air pump that is mounted on said footwear and is connectable with said tank member.

33. A footwear comprising:

a tank member formed inside said footwear so as to be in contact with a part of at least one of a toe, an instep and an ankle of a user, for applying a pressure to said part of at least one of said toe, said instep and said ankle of said user;

air pumping means for externally filling said tank member with air;

pressure measuring means, mounted on said footwear, for measuring an air pressure within said tank member, when said tank member is filled with air by said air pumping means, and for generating a pressure signal; and pressure data indicating means, mounted on said footwear, for indicating pressure data that corresponds to said pressure signal generated by said pressure measuring means.

34. A footwear according to claim 33, wherein said pressure measuring means and said pressure data indicating means are detachably mounted on said footwear.

35. A footwear according to claim 33, further comprising externally operable switch means for causing said pressure measuring means to start a measuring operation for measuring said air pressure within said tank member.

36. A footwear according to claim 33, wherein:

said pressure data indicating means comprises a plurality of indicating members; and said pressure data indicating means converts said pressure signal into digital data that digitally indicates said pressure data with said plurality of indicating members.

37. A footwear according to claim 33, further comprising timer means for causing said pressure measuring means to perform a measurement operation for measuring said air pressure within said tank member after at least a given time interval.

38. A footwear according to claim 33, wherein:

said air pumping means comprises a valve member provided on a part of said tank member; and said valve member is connectable with an external air pump for allowing air to be pumped into said tank member.

39. A footwear according to claim 33, wherein said air pumping means comprises an air pump, mounted on said footwear, that is connectable with said tank member.

40. A footwear comprising:

a tank member formed inside said footwear so as to be in contact with a foot of a user, for applying a pressure to said foot of said user;

air pumping means for externally filling said tank member with air;

pressure measuring means, mounted on said footwear, for measuring an air pressure within said tank member, when said tank member is filled with air by said air pumping means. and for generating a pressure signal;

externally operable switch means for causing said pressure measuring means to start a measuring operation of said air pressure within said tank member; and pressure data indicating means for indicating pressure data corresponding to said pressure signal generated by said pressure measuring means, said pressure measuring means starting a measuring operation upon an actuation of said externally operable switch means.

41. A footwear according to claim 40, wherein:

said pressure data indicating means comprises a plurality of indicating members; and said pressure data indicating means converts said pressure signal into digital data that indicates said pressure represented by said pressure signal with said plurality of indicating members.

42. A footwear according to claim 40, wherein said pressure measuring means and said pressure data indicating means are detachably mounted on said footwear.

43. A footwear according to claim 40, further comprising timer means for causing said pressure measuring means to perform a measurement operation after an operation of said externally operable switch means, to measure said air pressure within said tank member after at least a given time interval.

44. A footwear according to claim 40, wherein:

said air pumping means comprises a valve member provided on a part of said tank member; and said valve member is connectable to an external air pump for allowing air to be pumped into said tank member.

45. A footwear according to claim 40, wherein:

said air pumping means comprises an air pump, mounted on said footwear; member; and said air pump is connected to said tank member.

* * * * *